United States Patent [19]

Adams et al.

[11] 4,354,880

[45] Oct. 19, 1982

[54] METHOD OF FORGE-CONDITIONING NON-FERROUS METALS PRIOR TO ROLLING

[75] Inventors: Ronald D. Adams; E. Henry Chia, both of Carrollton, Ga.

[73] Assignee: Southwire Company, Carrollton, Ga.

[21] Appl. No.: 248,189

[22] Filed: Mar. 30, 1981

Related U.S. Application Data

[63] Continuation-in-part of Ser. No. 80,368, Oct. 1, 1979.

[51] Int. Cl.[3] ..... C22F 1/08

[52] U.S. Cl. ..... 148/2; 148/11.5 C; 164/76.1

[58] Field of Search ..... 148/11.5 C, 2, 11.5 R; 164/76; 29/527.7, 526.3; 72/202, 206, 402

[56] References Cited

U.S. PATENT DOCUMENTS

| | | | |
|---|---|---|---|
| 3,315,349 | 4/1967 | Cofer | 164/76 |
| 3,333,452 | 8/1967 | Sendzimir | 164/76 |
| 3,672,430 | 6/1972 | Cofer | 164/76 |
| 4,044,586 | 8/1977 | Properzi | 29/527.7 |

OTHER PUBLICATIONS

Application Data Sheet, Copper Development Association, Inc., "Standard Designations for Copper and Copper Alloys", pp. 1, 3 and 18.

*Primary Examiner*—Peter K. Skiff

*Attorney, Agent, or Firm*—Herbert M. Hanegan; Stanley L. Tate; Robert S. Linne

[57] ABSTRACT

A method of continuously casting a molten metal in a casting means to obtain a solidified cast bar at a hot-forming temperature, passing the cast metal at a hot-forming temperature from the casting means to a hot-forming means, and hot forming the cast bar into a wrought product by a two-stage reduction of its cross-sectional area while it is still at a hot-forming temperature, including, in the first stage, the step of forming a shell of finely distributed recrystallized grains in the surface layers of the cast bar by compressive forging affecting at least the surface layer of the cross section of the bar in its as-cast condition prior to the second stage in which substantial reduction of its cross-sectional area by rolling deformation forms the desired wrought product. The shell of fine grains formed on the cast bar during the first stage of compressive deformation permits substantial reduction of the cross-sectional area of the cast bar during the second stage of rolling deformation without the cast bar cracking, even when the cast bar has a high impurity content or is otherwise susceptible to intergranular rupturing.

12 Claims, 6 Drawing Figures

METHOD OF FORGE-CONDITIONING NON-FERROUS METALS PRIOR TO ROLLING

CROSS-REFERENCE TO RELATED APPLICATIONS

This application is a continuation-in-part of our copending application Ser. No. 80,368, filed on Oct. 1, 1979.

BACKGROUND OF THE INVENTION

The present invention relates to the hot forming of non-ferrous metals, and more particularly relates to the continuous casting and hot forming of the as-cast bars of certain impure copper or aluminum alloys which are otherwise prone to crack during hot-rolling, i.e. exhibit "hot-shortness".

It is well known that many common non-ferrous metals, such as copper, may be continuously cast, either in stationary vertical molds or in a rotating casting wheel, to obtain a cast bar which is then immediately hot formed, while in a substantially as-cast condition, by passing the cast bar exiting the mold to and through the multiple roll stands of a rolling mill while the cast bar is still at a hot-forming temperature. It is also well known that the as-cast structure of the metal bar is such that cracking of the cast bar during hot forming may be a problem if the cast bar is required to be directly hot formed into a semi-finished product, such as redraw rod, during which the initially large cross-sectional area of the cast bar must be substantially reduced, by a plurality of deformations along different axes, to provide a much smaller cross-sectional area in the product. See for example, the discussion of cracking U.S. Pat. No. 3,349,471.

While this problem could be avoided by casting a cast bar having an initially small cross-sectional area which need not be substantially reduced to provide the desired cross-sectional area of the final product, this approach is not commercially practical since high casting outputs, and therefore low costs, can be readily achieved only with cast bars having large cross-sectional areas which are rapidly reduced to the smaller cross-sectional areas of the products, such as ⅜" diameter rod for drawing into wire, by a minimum number of severe deformations. Thus, the problem of a cast bar cracking during hot forming must be solved within the commercial context of cast bars having initially large cross-sectional areas which are then hot formed into products having small cross-sectional areas by a minimum number of reductions which often are substantial enough to cause cracking of the cast bar under certain rather common conditions as discussed below.

This problem has been overcome in the prior art for relatively pure electrolytically-refined copper having low impurity levels such as 3–10 ppm lead, 1 ppm bismuth, and 1 ppm antimony. For example, U.S. Pat. No. 3,317,994, and U.S. Pat. No. 3,672,430 disclose that this cracking problem can be overcome by conditioning such relatively pure copper cast bar by initial large reductions of the cross-sectional area in the initial roll stands sufficient to substantially destroy the as-cast structure of the cast bar. The additional reductions along different axes of deformation, which would cause cracking of the cast bar but for the initial destruction of the as-cast structure of the cast bar, may then safely be performed. This conditioning of the cast bar not only prevents cracking of the cast bar during hot forming but also has the advantage of accomplishing a large reduction in the cross-sectional area of the cast bar while its hot-forming temperature is such as to minimize the power required for the reduction.

The prior art has not, however, provided a solution to the cracking problem described above for many metals, such as fire-refined scrap copper, containing a relatively high degree of impurities, or for initially pure cathodic copper which has become contaminated, during the melting and casting process, with a high volume fraction of intermetalic oxides and/or gas bubbles. This is because the large amount of impurities collect in the grain boundaries of the coarse as-cast structure and cause the cast bar to crack when an attempt is made to substantially destroy this coarse as-cast structure with the same large initial reduction of the cross-sectional area of the cast bar that is known to be effective with low impurity metals. Moreover, the greater the percentage of impurities in the cast bar, the more likely it is that cracks will occur during hot rolling. This problem is sometimes called "hot-shortness".

Thus, although there is no requirement for high-purity electrolytically-refined copper (except for specialized uses such as magnet wire) it has heretofore been necessary to use such highly refined copper in order to be able to use and obtain the many advantages of tandem continuous casting and hot-forming apparatus. As a result, a substantial refining cost is added to the price of many final copper products even though high purity is not required to meet conductivity or other physical specifications. For example, fire-refined copper wire having a moderately high degree of impurities (such 25 ppm Pb & Sn & 20 ppm Fe, etc.) can meet the IACS conductivity standard for household electrical wiring and can be produced more economically (since the copper cost is about 10 to 20% less) if the rod to be drawn into such wire can be produced using known continuous casting and hot-forming apparatus.

SUMMARY OF THE INVENTION

The present invention solves the above-described cracking problem of the prior art by providing a method of continuously casting and hot forming both low and high impurity metals without substantial cracking of the cast bar occurring during the hot rolling process. Generally described, the invention provides, in a method of continuously casting molten metal to obtain a cast bar with a relatively large cross-sectional area, and hot forming the cast bar at a hot-forming temperature into a product having a relatively small cross-sectional area by a substantial reduction of the cross-sectional area of the cast bar which is such that the coarse as-cast structure of the cast bar would be expected to cause the cast bar to crack, the additional step of first forming a shell of finely distributed recrystallized grains in at least the surface layers of the cast bar prior to subsequent substantial rolling reduction of the cross-sectional area of the cast bar, said shell being formed by a tension free forging process, similar in some respects to rotary swaging, while at a hot-forming temperature.

A preferred apparatus for performing this initial conditioning of the as-cast bar is the unique type of forge manufactured by Sendzimir Engineering Corp. shown in U.S. Pat. No. 3,921,429 and known in the art as a Sendzimir or Sencor forging mill.

Basically the apparatus consists of pairs of reciprocating pressing tools disposed to compress the edges of the cast bar while being also oscillated in the direction of bar movement so as to eliminate any pushing or draging forces on the fragile hot cast bar.

An important discovery of the present invention is the source of one of the more significant aspects of the cracking phenomenon seen in the prior art processes.

It has been found that sufficiently large tensile forces are created in the fragile cast bar during the usual continuous hot rolling process which will cause the surface layers of the bar to rupture whenever the local impurity level is high enough to weaken the grain boundaries and lower the ductility of the as-cast bar. This rupturing will occur even when the overall impurity level is low enough to make acceptable products because most impurities are concentrated during solidification along the relatively large grain boundaries of the cast bar. By first destroying the as-cast structure under tension-free conditions, the cracking problem is minimized and the conditioned bar can subsequently be hot rolled by the usual process. It has also been found that it is only necessary to condition the surface layers of the cast bar, preferably by numerous small compressions using the aforementioned apparatus.

The light deformations are each of a magnitude (about 3% to 18%, but preferably 5% to 15% and typically 10%) which will not cause the cast bar to crack, but which in combination with the hot-forming temperature of the cast bar will cause the cast bar to have a surface layer of finely distributed recrystallized grains of a thickness sufficient (about 10% of the cross-sectional area) to prevent cracking of the cast bar (even when having moderately high impurities) during the subsequent substantial deformations during rolling. The surface layer of fine grains provided by the invention allows substantial reduction of the cross-sectional area of the bar in a subsequent rolling pass, even in excess of 40%, without cracking occurring and even though the cast bar has a relatively high amount of impurities.

For example, the present invention allows a copper cast bar having a rectangular cross-sectional area of 5 square inches, or more, and containing as much as 50–200 ppm of impurities, such as lead, bismuth, iron and antimony, to be continuously cast and hot formed into wrought copper rod having a cross-sectional area of ½ square inch, or less, without cracking at speeds above 2000 fpm.

Furthermore, the invention has wide general utility since it can also be used with certain other less ductile non-ferrous metals as an alternative to the solution to the problem of cracking described in U.S. Pat. No. 3,317,994, and U.S. Pat. No. 3,672,430.

Thus, it is an object of the present invention to provide an improved method of continuously casting a molten metal to obtain a cast bar and continuously hot forming the cast bar into a product having a cross-sectional area substantially less than that of the cast bar without cracking of the cast bar occurring during hot forming.

It is a further object of the present invention to provide a method of and apparatus for continuously hot-forming non-ferrous metal containing a relatively high percentage of grain-boundary impurities without using specially shaped reduction rolls in the hot-rolling mill or other complex rolling procedures.

It is a further object of the present invention to provide a continuous method whereby a non-ferrous cast bar may be efficiently hot-formed, using fewer roll stands following conditioning of the cast metal, by first forming a shell of finely distributed recrystallized grains at the surface of the cast metal, then hot rolling the modified structure by successive heavy deformations.

It is a further object of the present invention to provide an integrated method for continuously casting and hot-forming fire-refined copper having in excess of 50 ppm impurities.

Further objects, features and advantages of the present invention will become apparent upon reading the following specification when taken in conjunction with the accompanying drawing.

DESCRIPTION OF THE PREFERRED EMBODIMENTS

Figure 1:
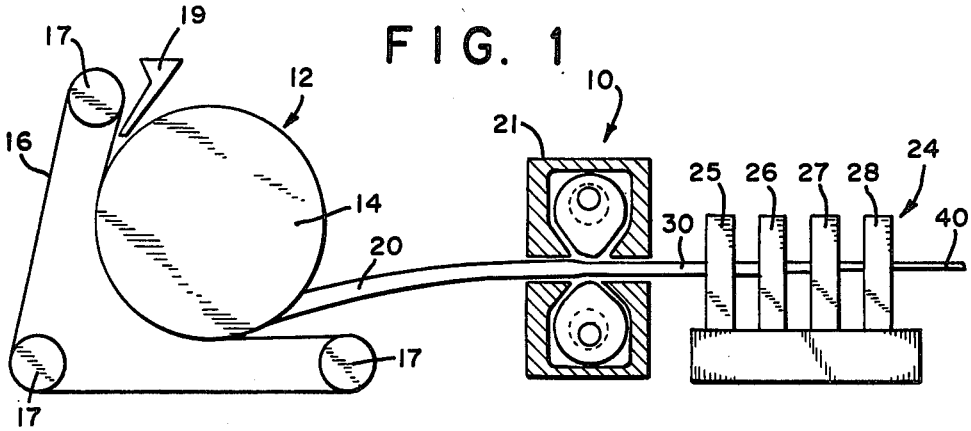
FIG. 1 is a schematic representation of casting and forming apparatus for practicing the method of the present invention.

Referring now to the drawing, in which like numerals refer to like parts throughout the several views, FIG. 1 schematically depicts an apparatus for practicing the method of the present invention. The integrated continuous casting and hot-forming system includes a casting means (12), a conditioning means (10), and a rolling means (24).

The casting machine (12) comprises a rotatable casting wheel (14) having a peripheral groove therein, a flexible band (16) carried by a plurality of guide wheels (17) which bias the flexible band (16) against the casting wheel (14) over a portion of the circumferential groove of the casting wheel (14) so as to cover the peripheral groove and thereby form a mold cavity in the groove between the band (16) and the casting wheel (14). As molten metal is poured into the mold through the pouring spout (19), the casting wheel (14) is rotated and the band (16) moves with the casting wheel (14) to form a moving mold. A cooling system (not shown) within the casting machine (12) causes the molten metal to solidify in the mold which then exits the casting wheel (14) as a substantially solid cast bar (20).

From the casting machine (12), the hot cast bar (20) passes through a tension-free forging means (10). The forging means, shown in more detail in FIG. 3, lightly compresses the bar to form a layer or partial shell of finely distributed grain structure (35) at the surface of the bar as shown in FIG. 4. After forging, the bar (30) is passed through a conventional rolling mill (24), which includes a plurality of roll stands (25), (26), (27) and (28). The roll stands of the rolling mill (24) provide the primary means of hot forming the cast bar by compressing and elongating the conditioned bar sequentially until the bar is reduced to a rod (40) having a desired cross-sectional size and shape, typically ⅜" dia. rod for drawing into wire.

Figure 2:
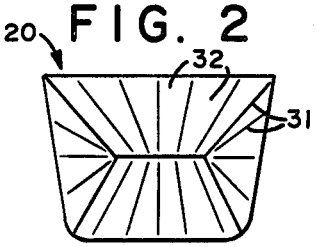
FIG. 2 illustrates a cross-section of a cast bar in substantially an as-cast condition (in this case having columnar grain structure).
Figure 6:
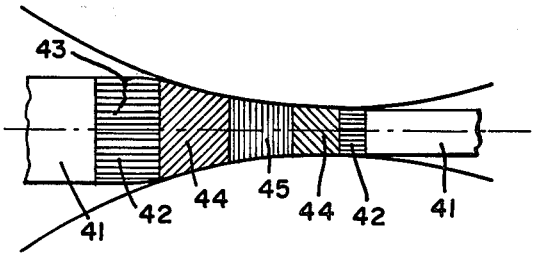
FIG. 6 is a schematic representation of the stress conditions in a cast bar during hot-rolling.

The grain structure of the cast bar (20) as it exits from the casting machine (12) is shown in FIG. 2. The molten metal solidifies in the casting machine in a fashion that can be columnar, or equiaxed, or both, depending on the cooling rate. This as-cast structure can be characterized by coarse grains (32) extending radially from the surfaces of the bar (if columnar) and separated from each other by grain boundaries (31). Most of the impurities present in the cast bar are located along these grain or dendrite boundaries (31). If the molten copper poured through the spout (19) into the casting wheel (14) were only fire-refined, and not electrolytically-refined, and the cast bar (20) was passed immediately to the rolling mill (24) without passing through the forging means (10), the impurities along the boundaries (31) of the cast bar (20) would likely cause the cast bar to crack (43) at the boundaries during heavy deformation by the first roll stands (25) of the rolling mill (24) (as illustrated in FIG. 6).

Figure 3:
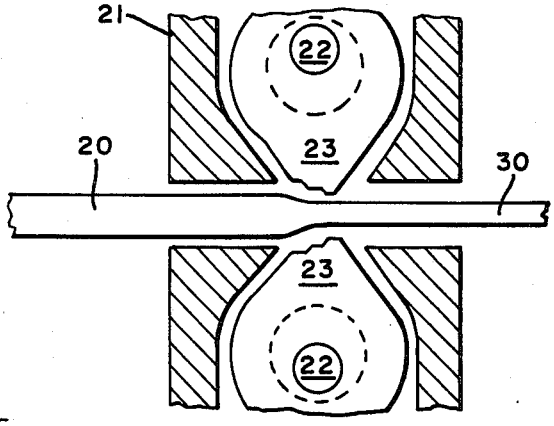
FIG. 3 illustrates apparatus suitable for the preliminary forging of the hot cast bar.
Figure 4:
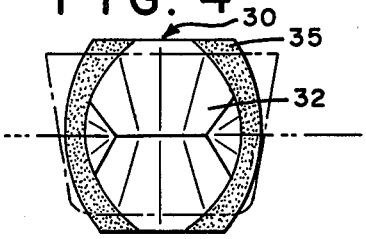
FIG. 4 is a cross-section of the cast bar shown in FIG. 2 following the initial forging step which forms a layer of finely distributed grains near the surface of the bar.

The tension-free forging means (10) is illustrated in more detail in FIG. 3 and generally comprises a housing (21) supporting a pair of forging hammers (23). These forging hammers may be mounted vertically (as illustrated in FIG. 3) and/or horizontally. Preferably two sets are used, one each, so as to work all surfaces of the cast bar. However one set may be used if the forging hammers are shaped so as to work the areas of the cast bar which are most prone to cracking, typically the corners and sides of the bar, as shown in FIG. 4.

The forging hammers (23) are preferably rotatable on an eccentric shaft (22) so that as the shaft rotates, the hammers (23) are first spaced apart sufficiently to allow the cast bar (20) to pass between them, then after further rotation of the eccentric shaft, the hammers (23) lightly compress the cast bar thereby reducing its cross-sectional area by a series of purely compressive strokes.

The working surface of the hammers (23) are preferably stepped or tapered and the bar speed is related to the rotational speed of the hammers so that as the cast bar (20) passes between the reciprocating hammers, the first step compresses the cast bar surface while the next steps again compresses the portions once compressed by the preceeding steps. Thus each stroke of the hammers results in multiple small deformations of the bar.

Each of the individual light compressions should preferably be between 5–15% reduction so as not to crack the bar (20) during conditioning. The total preliminary deformation provided by the forging means (10) may be about 10% to 40% so as to provide fine grains (35) of sufficient depth (about 10%) to prevent cracking of the bar during subsequent deformation of the bar when passing through the roll stands (25–28) of the rolling mill (24).

It will be understood that the formation of the layers or shell of fine or equiaxed grain structure may be accomplished by a forging means comprising about any type of forming tools, such as extrusion dies, multiple forging hammers, etc., so long as the preliminary forming deformation of the metal introduce only insignificant tensile stresses and results in a shell of recrystallized grains covering substantially the entire surface of the bar, or at least the areas most subject to cracking, such as corners of a rectangular bar.

When the shape of the bar in its as-cast condition includes prominent corners such as those of the bar shown in FIG. 2, the shape of the compressing surfaces in the forging means (10) may be designed to avoid excessive compression of the corner areas as compared to the other surfaces of the cast bar, so that cracking will not result at the corners.

Figure 5:
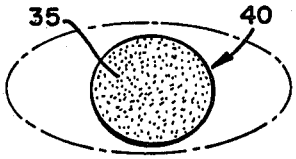
FIG. 5 is a cross-section of the partially forged cast bar shown in FIG. 4 following the subsequent hot rolling steps.

FIG. 5 illustrates a cross-section of the wrought rod (40) following a substantial reduction of the cross-sectional area by the roll stands (25 to 28) of the rolling mill (24). The remaining as-cast structure (32) in the interior of the bar (30) shown in FIG. 4, has been recrystallized to form finely distributed equiaxed grains (35).

When a layer of fine grains (35) has been formed on the surface of the forged bar (30), a high reduction may be taken at the first roll stand (25) of the rolling mill (24). It has been found that such initial hot-forming compression may be in excess of 35% or 40% following conditioning according to the present invention. The ability to use very high reductions during subsequent hot-forming means that the desired final cross-sectional size and shape may be reached using a rolling mill having a few roll stands. Thus, even though the forging means according to the present invention requires additional apparatus, the total amount and therefore cost of the conditioning and hot-forming apparatus may be reduced. In addition, it is known that heavy reductions are necessary to completely eliminate traces of the original cast structure in the rod.

FIG. 6 illustrates the deformation of a bar by rolling which is believed to introduce complex stresses in the bar as follows. The portions of the bar which are relatively far from the rolls (41) are essentially stress-free, unless of course there is an overall force on the bar tending to push or pull it between roll stands. The portion of the bar which first makes contact with the rolls (44) are exposed to compressive stresses high enough to make the metal flow (elongate and spread), i.e. the plastic deformation zone. The portions of the bar (42) between these two aforementioned zones (41 and 44) contain complex stresses which are generally too low to cause metal flow (i.e. elastic stresses) which do not cause plastic strain but high enough to cause cracking (43) if there are areas of weakness near the surface of the bar. This is mainly because at this point the interior of the bar usually experiences predominately compressive stresses while the surface layers experience tensile stresses due to pull from adjacent metal being reduced by the rolls.

After the bar passes further into the bite of the rolls (45) the stress pattern again changes and the bar experiences predominately compressive stresses except for a very low and shallow tensile stress on the very surface due to friction between the moving roll and the bar (this is often called the slipping zone).

From the foregoing brief discussion, it should be apparent that rolling deformation, especially at heavy reductions, which is usually thought of as a compressive operation actually introduces tensile stresses in the surface layers of a cast bar. These stresses then cause cracking along lines of weakness in the hot cast bar.

The method of the present invention allows continuous casting and rolling of high impurity metals, such as fire-refined copper generally including a total of from 50 to 200 ppm lead, bismuth, iron and antimony without cracking the bar. Furthermore, cracking is prevented throughout the hot-forming temperature range of the metal. In addition, the method of the present invention is effective for processing electrolytically-refined copper as well. Thus, the same casting and hot-forming apparatus may be used to produce metals of varying purity depending on the standards which must be met for a particular product. It is no longer necessary to add the cost of additional refining to the cost of the final product when a highly pure product is not specifically required.

If it is desired to reduce even further the possibility of cracking, elliptically shaped rolling channels may be provided for all of the roll stands (25–28) in order to provide optimal tangetial velocities of the rolls in the roll stands with respect to the cast metal, as disclosed in U.S. Pat. No. 3,317,994. However, such measures are usually not needed to avoid cracking if the present invention is practiced as described herein on metals having impurity levels as described above.

While this invention has been described in detail with particular reference to preferred embodiments thereof, it will be understood that variations and modifications can be effected within the spirit and scope of the invention as described herein before and as defined in the appended claims.

What is claimed is:

1. In a method of continuously casting a high-impurity copper in a wheel-belt machine and hot forming said cast metal in substantially its as-cast condition at a hot-forming temperature by a plurality of substantial rolling compressions, the improvement comprising the steps of:

following casting of said metal and prior to said substantial rolling compression of said metal, forming a layer of finely distributed recrystallized grains at least at the surface of said metal by at least one tension-free forging compression of said metal.

2. The method of claim 1 wherein said at least one forging compression reduces the cross-section of said metal by between 3 to 18% prior to the rolling compression.

3. The method of claim 1 wherein said forging compression comprises a first 5% to 15% reduction of the cross-section of said metal followed by a second 5% to 15% reduction along an axis of compression 90° removed from said first reduction.

4. The method of claim 1, wherein said substantial rolling compressions following the forming of said shell further includes a subsequent first rolling compression providing at least 40% reduction of the cross-sectional area of said metal.

5. The method of claim 1 wherein said metal is copper having at least 50 ppm impurities.

6. The method of claim 1 wherein said metal is fire-refined copper.

7. The method of claim 1 wherein said metal is remelted copper scrap.

8. The method of claim 1 wherein said metal is tough pitch grade copper.

9. A method of hot forming a continuously cast fire-refined copper bar without cracking said bar comprising the steps of:

passing said bar in substantially its as-cast condition and at a hot-forming temperature from a wheel-belt type continuous casting machine to a hot-forming means;

conditioning said bar for subsequent hot forming by forming a shell of finely distributed recrystallized grains at least at the surface of said bar by at least one preliminary tension-free forging compression of said bar thereby reducing the cross-section of said bar by between 5 to 15%;

then hot forming said bar by a single rolling compression of said bar to reduce its cross-sectional area by at least 40%; and further hot forming said bar by a plurality of sequential rolling compressions in each of which the cross-section of said bar is changed to the extent necessary to provide a hot-formed product having a predetermined cross-section.

10. The method of claim 9 wherein said at least one preliminary compression comprises a plurality of compressions each reducing the cast bar by about between 5% to 15% and the total reduction due to all compressions is between about 10% to 40%.

11. The method of claim 9 wherein said at least one preliminary compressions comprises a plurality of compressions, each reducing the cast bar by about 10%.

12. The method of claim 9 wherein the step of conditioning said bar further comprises:

advancing the cast bar along a path between eccentrically rotating forging hammers while rotating said hammers from a first position not in contact with said bar to a second position compressing said bar thence further rotating said hammers to said first position while continuing to advance said bar.

* * * * *